US009092948B2

(12) United States Patent
Bond et al.

(10) Patent No.: US 9,092,948 B2
(45) Date of Patent: Jul. 28, 2015

(54) METHOD OF GAMING, A GAME CONTROLLER AND A GAMING SYSTEM

(75) Inventors: Rowan Arthur Newman Bond, Elwood (AU); Boris Mitelman, Elwood (AU); Christian James Salmon, Maidstone (AU)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 933 days.

(21) Appl. No.: 12/794,427

(22) Filed: Jun. 4, 2010

(65) Prior Publication Data

US 2010/0317426 A1 Dec. 16, 2010

(30) Foreign Application Priority Data

Jun. 12, 2009 (AU) ..... 2009902709

(51) Int. Cl.

| | |
|---|---|
| ***A63F 9/24*** | (2006.01) |
| ***G07F 17/34*** | (2006.01) |
| *G07F 17/32* | (2006.01) |

(52) U.S. Cl.

CPC ..... *G07F 17/34* (2013.01); *G07F 17/326* (2013.01); *G07F 17/32* (2013.01)

(58) Field of Classification Search

CPC ..... G07F 17/32; G07F 17/326; G07F 17/34
USPC ..... 463/16–20
See application file for complete search history.

(56) References Cited

U.S. PATENT DOCUMENTS

| | | | | |
|---|---|---|---|---|
| 2003/0036423 | A1 | 2/2003 | Vancura | |
| 2004/0171419 | A1 | 9/2004 | Walker et al. | |
| 2004/0229681 | A1 | 11/2004 | Romano | |
| 2007/0072673 | A1 | 3/2007 | Bennett et al. | |
| 2007/0117628 | A1 | 5/2007 | Stanley | |
| 2007/0259706 | A1 | 11/2007 | Anderson et al. | |
| 2008/0058062 | A1 * | 3/2008 | Okada | 463/20 |
| 2008/0064458 | A1 | 3/2008 | Yang | |
| 2008/0078758 | A1 | 4/2008 | Shimura et al. | |
| 2008/0113752 | A1 | 5/2008 | Nelson | |
| 2008/0113753 | A1 | 5/2008 | Nelson | |
| 2008/0113754 | A1 | 5/2008 | Nelson | |
| 2008/0125212 | A1 * | 5/2008 | Schofield | 463/20 |
| 2008/0194312 | A1 | 8/2008 | Nelson et al. | |
| 2008/0227550 | A1 | 9/2008 | Vallejo et al. | |
| 2008/0293478 | A1 | 11/2008 | Anderson et al. | |

(Continued)

FOREIGN PATENT DOCUMENTS

| | | |
|---|---|---|
| CA | 2460459 | 10/2004 |
| CA | 2527416 | 5/2007 |
| CA | 2537188 | 8/2007 |
| CA | 2594244 | 1/2008 |

(Continued)

*Primary Examiner* — Michael Cuff

(74) *Attorney, Agent, or Firm* — Hanley, Flight and Zimmerman, LLC

(57) ABSTRACT

A method of gaming in a gaming system includes conducting a plurality of game rounds, determining as part of each game round whether a designated game event has occurred, each designated game event conferring a benefit on the player in at least one game round, increasing a count in response to the designated game event occurring in a game round, and ending the series of game rounds in response to the count reaching a designated number, whereby the number of game rounds is determined by occurrence of the designated game event in plural game rounds to thereby set a minimum number of game rounds.

36 Claims, 7 Drawing Sheets

(56) References Cited

U.S. PATENT DOCUMENTS

| | | | | |
|---|---|---|---|---|
| 2008/0293481 | A1 | 11/2008 | Davies | |
| 2009/0011814 | A1 | 1/2009 | Lozano et al. | |
| 2009/0017906 | A1 | 1/2009 | Jackson | |
| 2009/0042645 | A1 | 2/2009 | Graham et al. | |
| 2009/0111569 | A1* | 4/2009 | Yoshizawa | 463/20 |
| 2009/0239622 | A1* | 9/2009 | Fujimori et al. | 463/20 |
| 2009/0247265 | A1* | 10/2009 | Abe | 463/20 |
| 2010/0075738 | A1* | 3/2010 | Roukis | 463/20 |
| 2010/0099482 | A1* | 4/2010 | O'Connor et al. | 463/20 |
| 2010/0124981 | A1* | 5/2010 | Kato et al. | 463/20 |
| 2012/0122547 | A1* | 5/2012 | Aoki et al. | 463/20 |

FOREIGN PATENT DOCUMENTS

| | | | |
|---|---|---|---|
| CA | 2555930 | | 2/2008 |
| CA | 2581520 | | 9/2008 |
| CN | 101015193 | | 8/2007 |
| CN | 101105825 | | 1/2008 |
| EP | 1498857 | | 1/2005 |
| EP | 1681659 | A1 | 7/2006 |
| GB | 2388046 | | 11/2003 |
| GB | 2432959 | | 6/2007 |
| NZ | 529071 | | 9/2005 |
| WO | 2007040674 | | 4/2007 |
| WO | 2007047977 | | 4/2007 |
| WO | 2007060850 | | 5/2007 |

* cited by examiner

METHOD OF GAMING, A GAME CONTROLLER AND A GAMING SYSTEM

CROSS-REFERENCE TO RELATED APPLICATIONS

The present application relates to and claims the benefit of priority from Australian Provisional Patent Application Number 2009902709, filed on Jun. 12, 2009, which is herein incorporated by reference in its entirety.

FIELD

The invention relates to a method of gaming, a game controller and a gaming system.

BACKGROUND

Known gaming systems provide games where a series of game rounds are carried out. Such game rounds, or free games, are typically provided as a feature game awarded in response to a trigger event occurring in a base game. Usually, the number of game rounds which are awarded is advertised to the player in advance and a counter shows the number of game rounds remaining. Some games allow the feature to be "re-triggered" if the trigger occurs again during the free game series.

While such gaming systems provide players with enjoyment, a need exists for alternative gaming systems in order to maintain or increase player enjoyment.

SUMMARY

In a first aspect, the invention provides a method of gaming in a gaming system including:

conducting a plurality of game rounds;

determining as part of each game round whether a designated game event has occurred, each designated game event conferring a benefit on the player in at least one game round;

increasing a count in response to the designated game event occurring in a game round; and ending the series of game rounds in response to the count reaching a designated number, whereby the number of game rounds is determined by occurrence of the designated game event in plural game rounds to thereby set a minimum number of game rounds.

In an embodiment, the benefit conferred by each designated game event persists until the series of game rounds ends.

In an embodiment, the method further includes evaluating each game round to determine whether to make an award to the player.

In an embodiment, each game round includes selecting symbols of a plurality of reels for display at a plurality of symbol display positions and evaluating each game round includes evaluating the symbols displayed at the symbol display positions to determine whether to make an award.

In an embodiment, the designated event includes the occurrence of a designated symbol.

In an embodiment, the designated symbol is a wild symbol.

In an embodiment, each designated symbol is required to occur in the symbol display positions corresponding to a designated reel.

In an embodiment, the plurality of designated events correspond to designated symbols occurring in symbol display positions of respective ones of a plurality of reels.

In an embodiment, each designated symbol is held in place, such that for the reel on which it occurs symbols are only selected for other display positions of that reel in any subsequent game rounds.

In an embodiment, the game is a feature game which is conducted in addition to a main game in response to a trigger condition being met.

In an embodiment, the designated event is the occurrence of one or more specified events in a game round such that the count increases by one irrespective of the number of specified events which occur in a game round.

In a second aspect, the invention provides a game controller for a gaming system, the game controller including:

a game round controller arranged to implement a plurality of game rounds; and a designated event monitor arranged to determine as part of each game round whether a designated game event has occurred, each designated game event conferring a benefit on the player in at least one game round, the game round controller arranged to:

increase a count in response to the designated game event occurring; and end the series of game rounds in response to the count reaching a designated number, whereby the number of game rounds is determined by occurrence of the designated game event in plural game rounds to thereby set a minimum number of game rounds.

In an embodiment, the game round controller is a feature game controller for conducting the game rounds as feature games in a feature game which is conducted in addition to a main game in response to a trigger condition being met, the main game being conducted by a main game controller.

In an embodiment, the game controller includes a game round evaluator arranged to evaluate each game round to determine whether to make an award to the player.

In an embodiment, the game controller is implemented at least in part by a processor executing memory code stored in a memory.

In an embodiment, the benefit conferred by each designated game event persists until the series of game rounds ends.

In an embodiment, each game round includes the game controller selecting symbols of a plurality of reels for display at a plurality of symbol display positions and the award evaluator evaluates each game round by evaluating the symbols displayed at the symbol display positions to determine whether to make an award.

In an embodiment, the designated event includes the occurrence of a designated symbol.

In an embodiment, the designated symbol is a wild symbol.

In an embodiment, each designated symbol is required to occur in the symbol display positions corresponding to a designated reel.

In an embodiment, the plurality of designated events correspond to designated symbols occurring in symbol display positions of respective ones of a plurality of reels.

In an embodiment, each designated symbol is held in place, such that for the reel on which it occurs symbols are only selected for other display positions of that reel in any subsequent game rounds.

In an embodiment, the designated event is the occurrence of one or more specified events in a game round such that the count increases by one irrespective of the number of specified events which occur in a game round.

In a third aspect, the invention provides gaming system including:

a display for displaying play of the game to a player; and a game controller arranged to:

conduct a plurality of game rounds;

determine as part of each game round whether a designated game event has occurred, each designated game event conferring a benefit on the player in at least one game round;

increase a count in response to the designated game event occurring in a game round; and end the series of game rounds in response to the count reaching a designated number, whereby the number of game rounds is determined by occurrence of the designated game event in plural game rounds to thereby set a minimum number of game rounds.

In an embodiment, the benefit conferred by each designated game event persists until the series of game rounds ends.

In an embodiment, the game controller is further arranged to evaluate each game round to determine whether to make an award to the player.

In an embodiment, each game round includes the game controller selecting symbols of a plurality of reels for display at a plurality of symbol display positions and the game controller evaluates each game round by evaluating the symbols displayed at the symbol display positions to determine whether to make an award.

In an embodiment, the designated event includes the occurrence of a designated symbol.

In an embodiment, the designated symbol is a wild symbol.

In an embodiment, each designated symbol is required to occur in the symbol display positions corresponding to a designated reel.

In an embodiment, the plurality of designated events correspond to designated symbols occurring in symbol display positions of respective ones of a plurality of reels.

In an embodiment, each designated symbol is held in place by the game controller, such that for the reel on which it occurs symbols are only selected by the game controller for other display positions of that reel in any subsequent game rounds.

In an embodiment, the game is a feature game which is conducted in addition to a main game in response to the game controller determining that a trigger condition has been met.

In an embodiment, the designated event is the occurrence of one or more specified events in a game round such that the game controller increases the count by one irrespective of the number of specified events which occur in a game round.

In a fourth aspect, the invention provides a gaming machine including:

a cabinet;

a display mounted within the cabinet for displaying play of the game to a player;

one or more input devices operable by a player to place a wager and initiate play of the game; and a game controller in data communication with the input devices and display, the game controller including a processor arranged to execute program code stored in a memory in order to conduct a game in response to operation of the one or more input devices, the program code including instructions such that at least occasionally, the game controller, will as part of game play:

conduct a plurality of game rounds;

determine as part of each game round whether a designated game event has occurred, each designated game event conferring a benefit on the player in at least one game round;

increase a count in response to the designated game event occurring in a game round; and end the series of game rounds in response to the count reaching a designated number, whereby the number of game rounds is determined by occurrence of the designated game event in plural game rounds to thereby set a minimum number of game rounds.

In a fifth aspect, the invention provides a gaming system including:

means for displaying play of a game to a player;

means for conducting a plurality of game rounds;

means for determining as part of each game round whether a designated game event has occurred, each designated game event conferring a benefit on the player in at least one game round;

means for increasing a count in response to the designated game event occurring in a game round; and means for ending the series of game rounds in response to the count reaching a designated number, whereby the number of game rounds is determined by occurrence of the designated game event in plural game rounds to thereby set a minimum number of game rounds.

In a sixth aspect, the invention provides computer program code which when executed implements the above method.

In a seventh aspect, the invention provides a computer readable medium including the above program code.

In an eighth aspect, the invention extends to transmitting the above program code.

BRIEF DESCRIPTION OF DRAWINGS

Certain embodiments of the invention will now be described with reference to the accompanying drawings in which.

Figure 1:
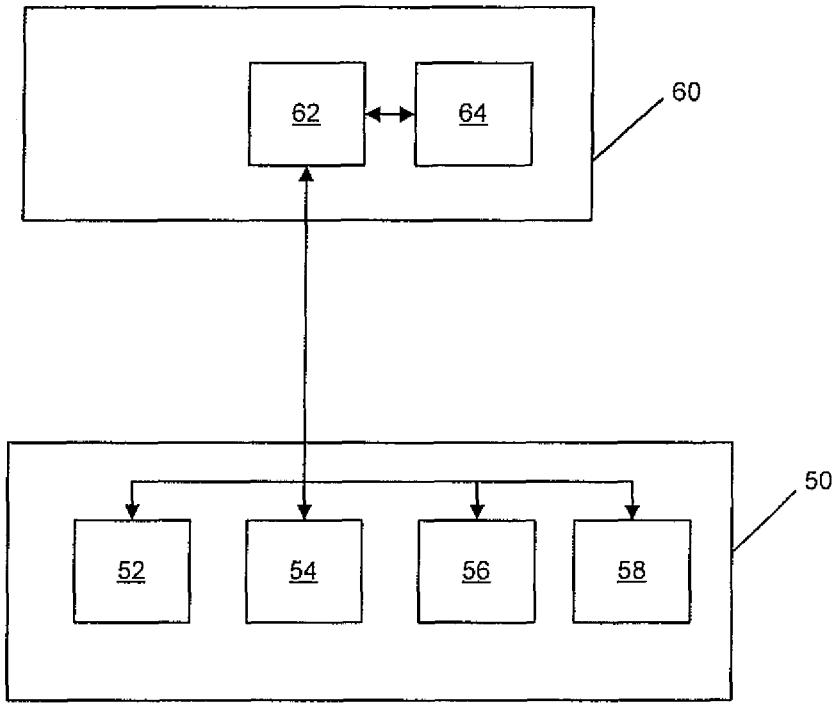
FIG. 1 is a block diagram of the core components of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Although the following discloses example methods, systems, articles of manufacture, and apparatus including, among other components, software executed on hardware, it should be noted that such methods and apparatus are merely illustrative and should not be considered as limiting. For example, it is contemplated that any or all of these hardware and software components could be embodied exclusively in hardware, exclusively in software, exclusively in firmware, or in any combination of hardware, software, and/or firmware. Accordingly, while the following describes example methods, systems, articles of manufacture, and apparatus, the examples provided are not the only way to implement such methods, systems, articles of manufacture, and apparatus.

When any of the appended claims are read to cover a purely software and/or firmware implementation, at least one of the elements in an at least one example is hereby expressly defined to include a tangible medium such as a memory, DVD, CD, Blu-ray, etc., storing the software and/or firmware.

Referring to the drawings, there is shown a gaming system having a game controller arranged to implement a game where a series of game rounds are conducted and a plurality of randomly occurring game events must occur in order for the series of game rounds to end. Advantageously, the length of the series of game rounds is unknown but of at least a minimum length as the plurality of game events must occur before the game rounds end. In some embodiments, the nature of the game events is chosen to ensure a high likelihood of a positive game outcome ending the series of game rounds.

General Construction of Gaming System

The gaming system can take a number of different forms. In a first form, a stand alone gaming machine is provided wherein all or most components to implement the game are present in a player operable gaming machine.

In a second form, a distributed architecture is provided wherein some of the components to implement the game are present in a player operable gaming machine and some of the components to implement the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
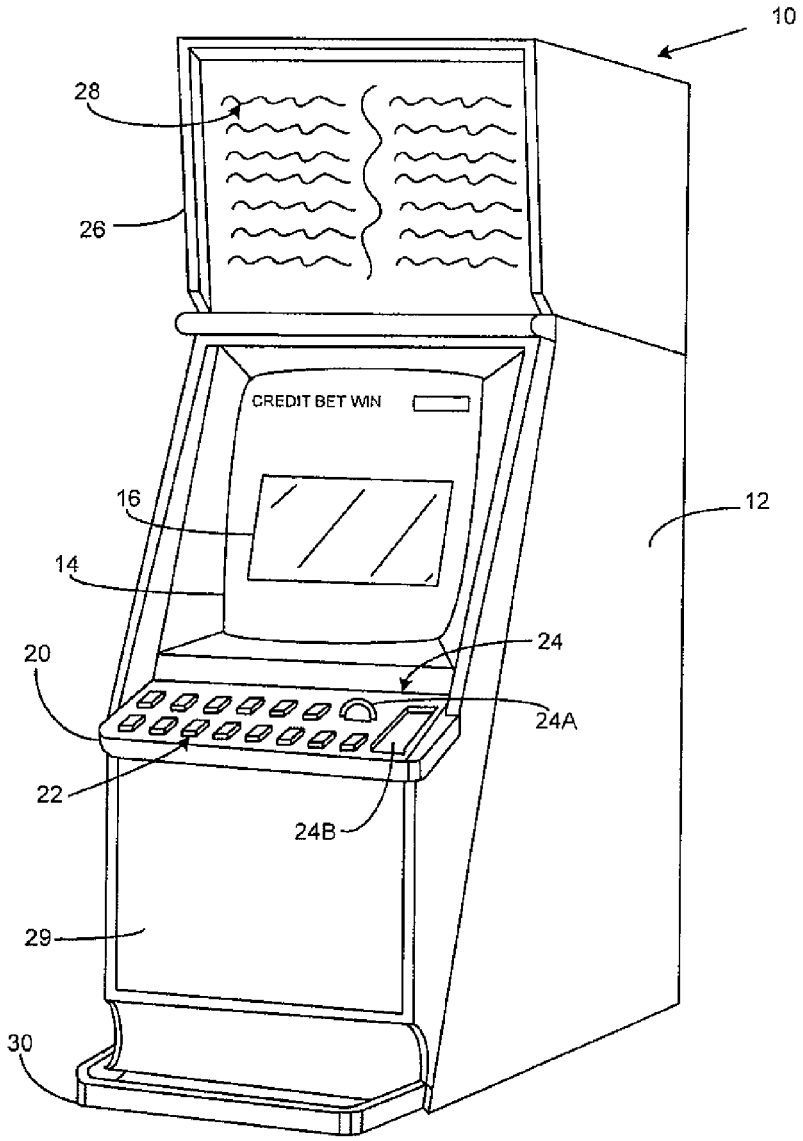
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
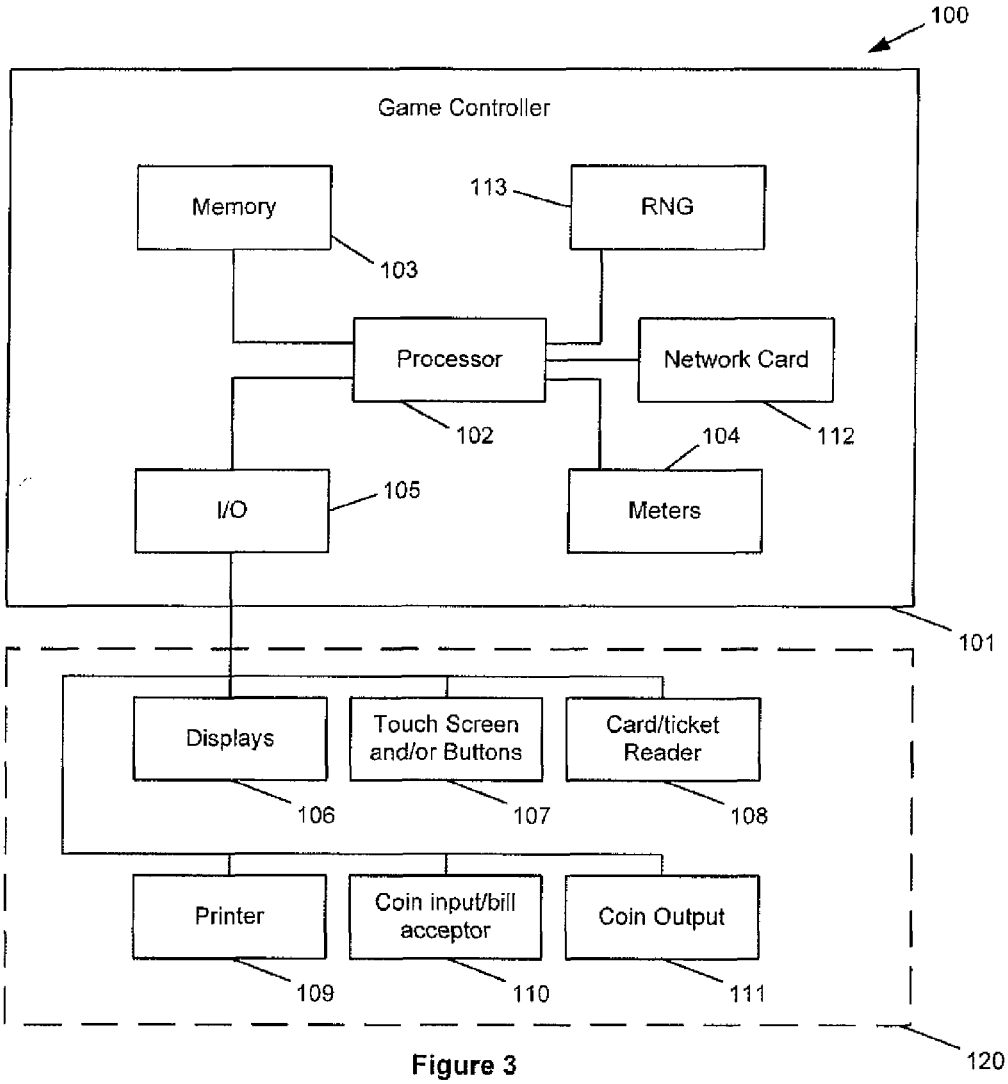
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted based on the specific implementation. For example, while buttons or touch screens are typically used in gaming machines to allow a player to place a wager and initiate a play of a game any input device that enables the player to input game play instructions may be used.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
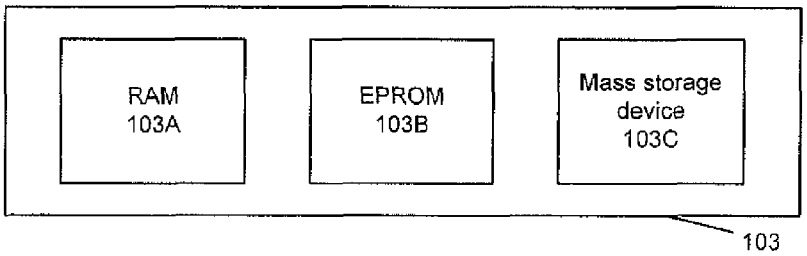
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
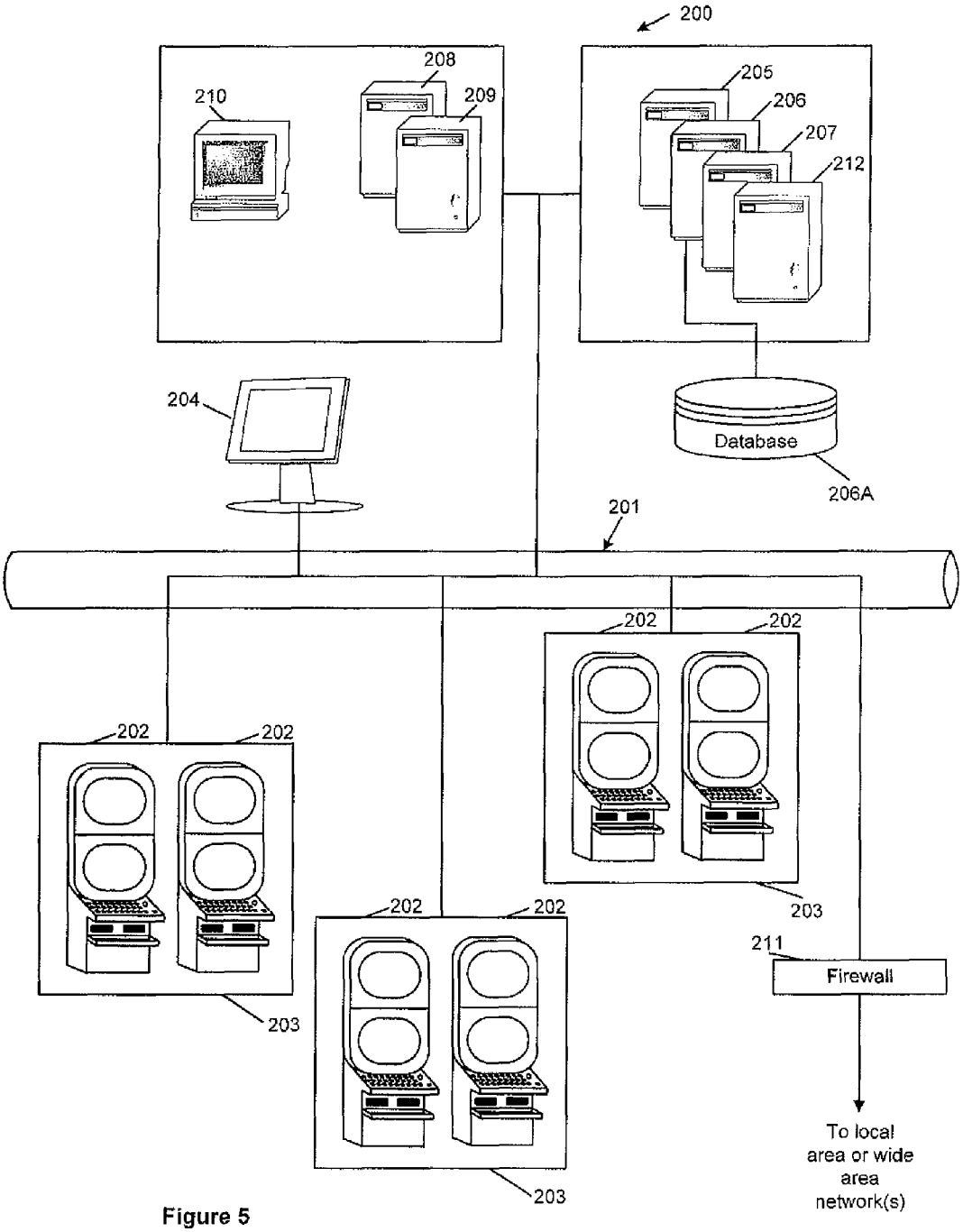
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the rules, guidelines, requirements, and/or preferences for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in further details of a server gaming architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games based on the terminals.

Further Detail of Gaming System

The embodiment, is described in relation to an advantageous arrangement where the game rounds to which the plural game event end condition applies are game rounds of a feature game of a spinning reel type game, however, persons skilled in the art will appreciate that the game rounds need not necessarily be of a feature game nor need the game be a spinning reel game but could be a dice game, a card game etc.

Persons skilled in the art will appreciate that a player's win entitlement will vary from game to game. In this embodiment, part of obtaining a win entitlement is effected by the player operating game play mechanism 56 to make a selection of either, a normal immediate return 56A or to indicate that the player accepts deferred payment 56B. Typically, the player's win entitlement lasts for a play of the game. Depending on the specific implementation, the length of a play may be fixed (e.g. a single spin of reels of a spinning reel game) or variable (e.g. may include any free games awarded). The play ends when nothing further can occur to affect the outcome. In the prior art, this is when credits resulting from any wins are transferred from the win meter to the credit meter.

The player operates the game play mechanism 56 to specify the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection). Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of pay lines and are an inherent part of the win entitlement.

Persons skilled in the art will appreciate that in other embodiments, the player may obtain a win entitlement by selecting a number of reels to play. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions include three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

In other embodiments a player win entitlement may be affected by purchasing access to particular pay tables—e.g. a first bet amount entitles the player to wins including cherries and a second amount entitles them to wins including plums.

Figure 6:
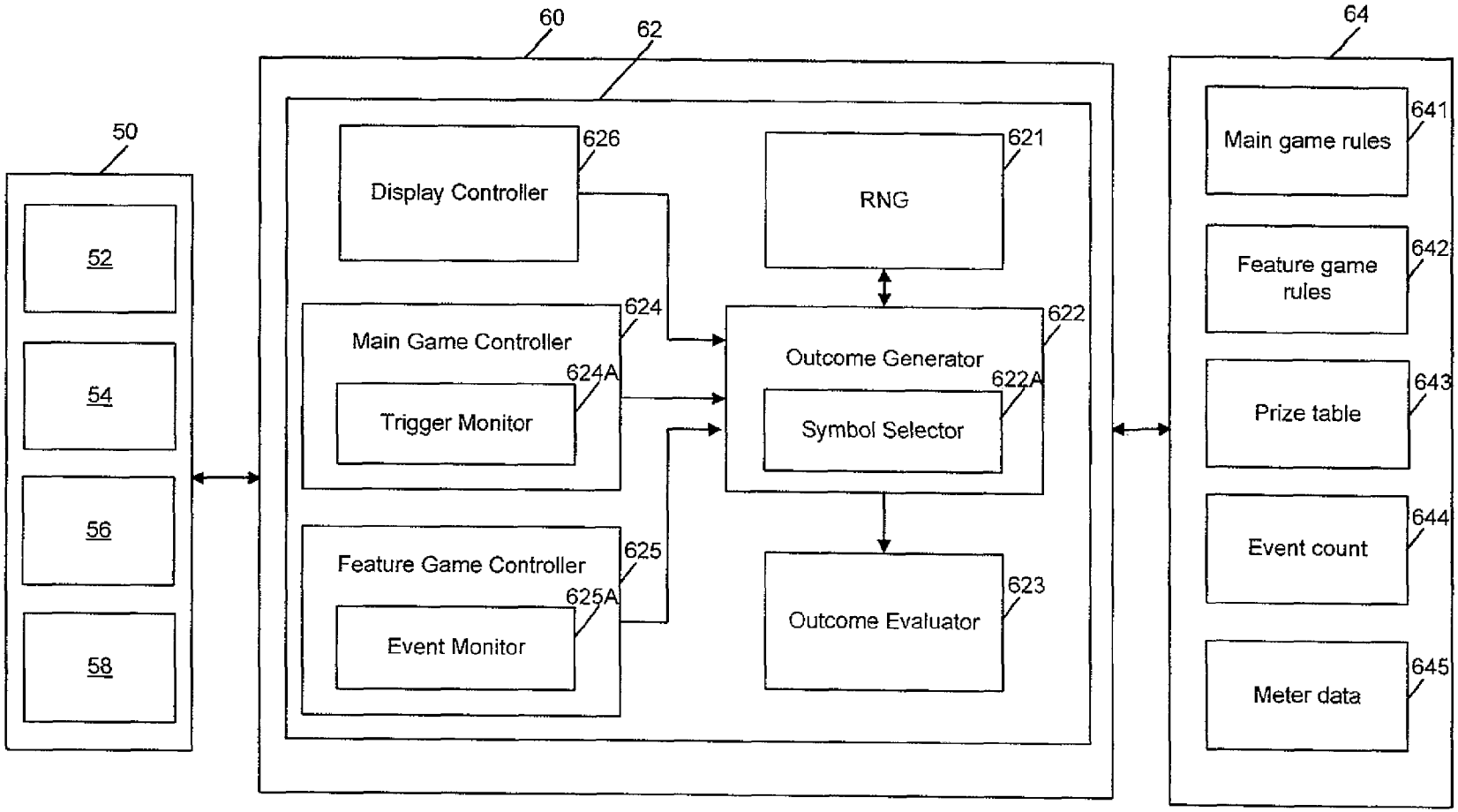
FIG. 6 is a further block diagram of a gaming system.

In FIG. 6, the processor 62 of game controller 60 is shown implementing a number of modules based on program code and data stored in memory 64. Persons skilled in the art will appreciate that various of the modules could be implemented in some other way, for example by a dedicated circuit.

These modules include the main game controller 624 which operates in response to the player's operation of game play mechanism 56 to place a wager and initiate a play of the game which includes deducting credit corresponding to the wager form the credit meter stored as meter data 645. Main game controller 624 controls outcome generator 622 to generate a game outcome based on main game rules 641 which will then be evaluated by award evaluator 623. The first part of forming the game outcome is for a symbol selector 622A to select symbols from a set of symbols specified by symbol data 641 using random number generator 621. The selected symbols are advised to the display controller 626 which causes them to be displayed on display 54 at a set of display positions.

One example of selecting symbols for a spinning reel game is for the symbol selector 622A to select symbols for display from a plurality of symbol sets corresponding to respective ones of a plurality of spinning reels. The symbol sets 641 can specify a sequence of symbols for each reel such that the symbol selector 622A can select all of the symbols by selecting a stopping position in the sequence. In one example, three symbols of each of five reels may be displayed such that symbols are displayed at fifteen display positions on display 54. It is known to use a probability table stored in memory 64 to vary the odds of a particular stop position being selected. Other techniques can be used to control the odds of particular outcomes occurring to thereby control the return to player of the game.

The outcome is evaluated by the outcome evaluator 623 based on the prize table and any awards are displayed to the player on display 54 by showing changes to a displayed version of a win meter stored as part of meter data 645. If no trigger event occurs, the game concludes and the balance of the win meter is transferred to the credit meter, and the game controller waits for the player to either cash out or initiate another play of the game.

Main game controller 624 includes a trigger monitor 624A to determine whether a trigger event has occurred in relation to play of the main game. The trigger event may be any of the trigger events known in the art such as a symbol combination in the game outcome, occurrence of a specific symbol in the game outcome, purchased, be caused by another connected system, based on turnover etc.

When a trigger event occurs, main game controller 624 passed control to feature game controller 625 which initiates a series of game rounds (and thus provides a game round controller), which in this embodiment are plural spins of reels where symbols are selected by symbol selector 622A of outcome generator 622 based on feature game rules 642 which are each evaluated by outcome evaluator 623 with any wins added to the win meter. When the feature game series is started, an event counter 645 is initially set to zero, an event monitor 625A monitors for the designated game event and updates the event counter 644. When the event counter reaches a designated number, feature game controller 625 ends the free game series. This can be by making the current free game the last free game or defining a specific time at which the free games will end, for example after one or two more spins.

The designated game event is one, which when it occurs, confers a benefit on the player in the sense that it either directly enhances winning game outcomes or makes it more likely that the player will achieve winning game outcomes. One example of a game event is the occurrence of a wild symbol which makes winning pay table outcomes more likely to occur. Another is the award of a multiplier. A particular example is of a held symbol such as a "sticky wild" which remains at the display position where it was selected for the duration of the free game series to thereby confer a benefit in subsequent game rounds. It will be appreciated that in such circumstances, the symbol selector 622A will, in effect, only select symbols for the other symbol positions as the held symbol supplants the symbol selected at its position. The game event may have to satisfy other conditions for it to be deemed a game event by the event monitor, for example it may need to occur in relation to a specific reel or it may not be a second occurrence of a game event within a specific game round. In another embodiment, a designated game event may be the combination of two specific events, e.g. two wilds being spun-up.

In some embodiments, an eligibility criteria may be applied for access to the feature game, for example that the player has made a certain sized wager, made an ante bet, selected all win lines, played sufficient games, or the player is a member of a loyalty program.

Figure 7:
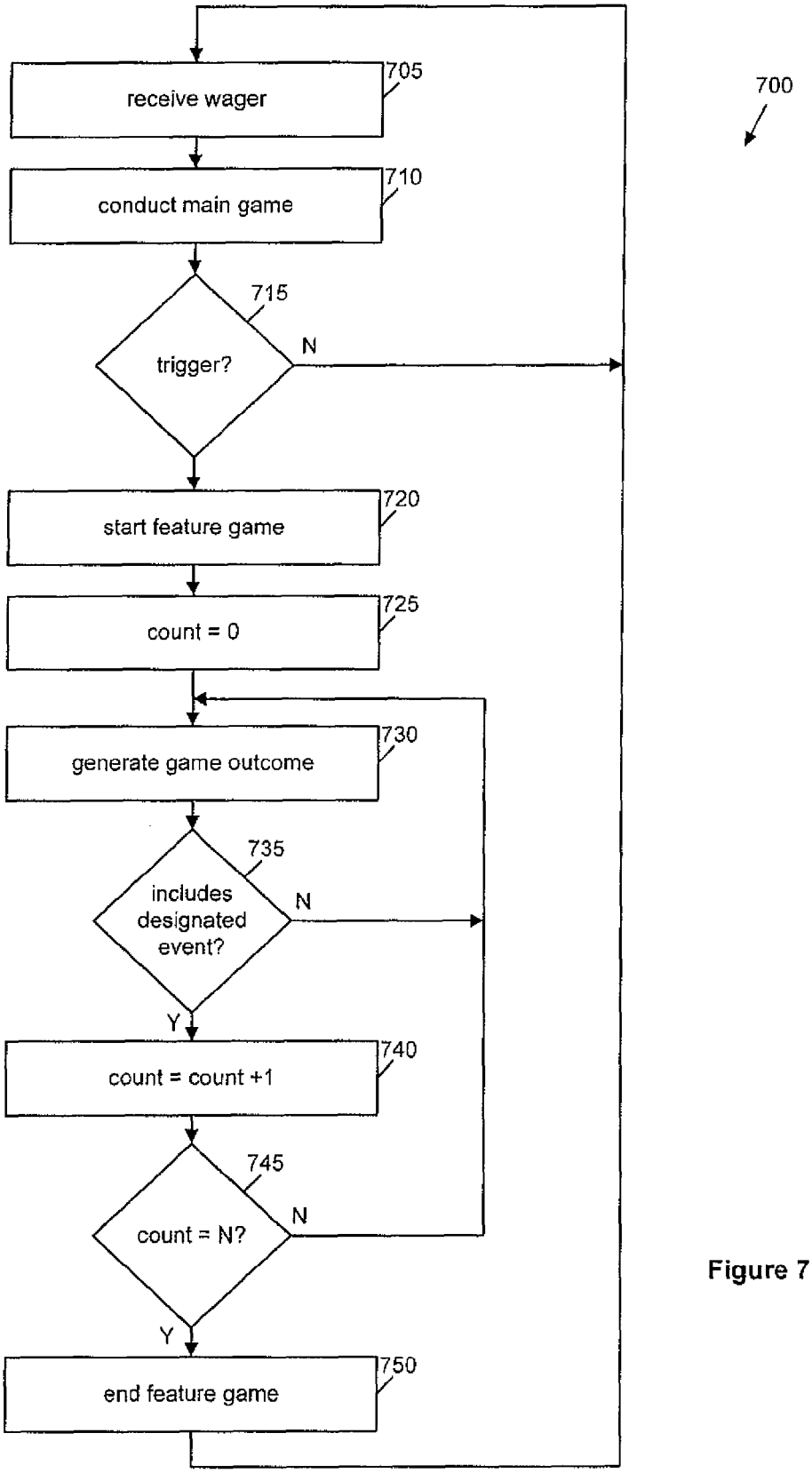
FIG. 7 is a flow chart of an embodiment.
Figure 8A:
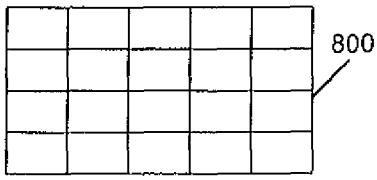
FIG. 8 illustrates an example of the game schematically.
Figure 8B:
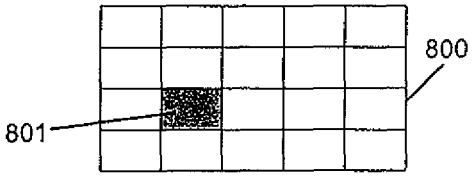
Figure 8C:
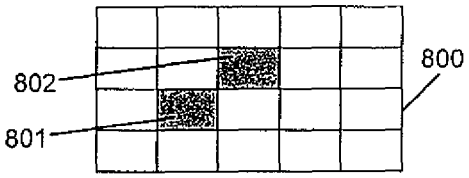
Figure 8D:
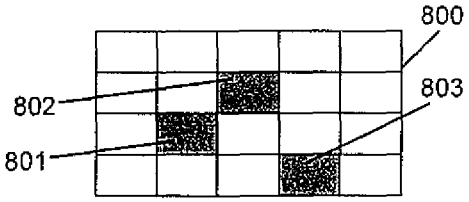
Figure 8E:
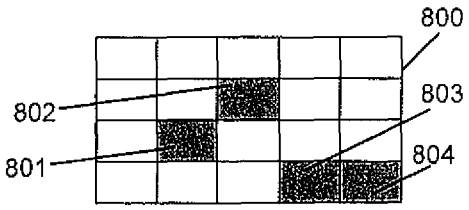

An example a method of gaming is illustrated in the flowchart of FIG. 7. FIG. 7 depicts an example flow diagram representative of processes that may be implemented using, for example, computer readable instructions that may be used to facilitate game play. The example processes of FIG. 7 may be performed using a processor, a controller and/or any other suitable processing device. For example, the example processes of FIG. 7 may be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example processes of FIG. 7 may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example processes of FIG. 7 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example processes of FIG. 7 may be implemented manually or as any combination(s) of any of the foregoing techniques, for example, any combination of firmware, software, discrete logic and/or hardware. Further, although the example processes of FIG. 7 are described with reference to the flow diagram of FIG. 7, other methods of implementing the processes of FIG. 8 may be employed. For example, the order of execution of the blocks may be changed, and/or some of the blocks described may be changed, eliminated, sub-divided, or combined. Additionally, any or all of the example processes of FIG. 7 may be performed sequentially and/or in parallel by, for example, separate processing threads, processors, devices, discrete logic, circuits, etc.

The method 700 is summarised in FIG. 7 and is initiated in response to receipt 705 of a wager after which a main game is conducted 710. It is determined 715 whether a trigger event occurs in relation to the main game and when a trigger event occurs a feature game is started 720 with a count being set 725 to zero. The method then involves generating 730 a game outcome for each feature game round and determining 735 whether it includes a designated event. When it includes a designated game event, the counter is incremented 740 and it is determined 745, whether the count has reached a designated number such that plural game events must occur before the feature game is ended 750 and hence a minimum number of benefits must have been conferred on the player.

EXAMPLE

Once the feature has been activated the free games commence.

At the commencement (see FIG. 8A) of the free games there are no sticky wilds in place on display 800.

The free games are continuously awarded until a succession of four wilds is spun up from left to right on reels 2 to 5.

Only one wild that is spun up can become sticky in each game. Accordingly, the designated game event is that one or more wild symbols is spun up. In other examples, each wild which is spun up can become sticky but sticky wilds must occur in plural game rounds for the feature to be terminated—i.e. the designated event is that one or more specified events (the sticky wilds) occurs in a game round. The first wild 801 spun up on reel 2 becomes a sticky wild (FIG. 8B) and is held in that place for the duration of the free games.

Once the sticky wild 801 is in place on reel 2 the single next wild 802 spun up on reel 3 (FIG. 8C) in subsequent games becomes a sticky wild and is held in place for the duration of the free games.

Once the sticky wild 802 is in place on reel 3 the single next wild spun up on reel 4 in subsequent games becomes a sticky wild 803 (FIG. 8D) and is held in place for the duration of the free games.

Once the sticky wild 803 is in place on reel 4, the single next wild spun up on reel 5 in subsequent games becomes a sticky wild 804 (FIG. 8E) and is held in place for the duration of the free games.

Once the sticky wild 804 is in place on reel 5 there is one last free game awarded with all 4 wilds stuck in place.

Once this last free game is awarded the feature is ended and the game reverts back to the base reel strip game.

In the above example, an extra free game is awarded at the end of the feature with all 4 sticky wilds held in place. That is, while the game ends in response to the $4^{th}$ sticky wild occurring, it does not end immediately. In another embodiment, this can be changed, for example, such that the free game series ends when the last wild is spun up. In a variation, it is possible to award a bonus prize when wilds reach reel 5.

Further aspects of the method will be apparent from the above description of the gaming system. Persons skilled in the art will also appreciate that the method could be embodied in program code. The program code could be supplied in a number of ways, for example on a tangible computer readable medium, such as a magnetic or optical disc or a memory (for example, that could replace part of memory 103), or as a data signal (for example, by transmitting it from a server).

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments and/or aspects without departing from the spirit or scope of the invention as broadly described. For example, it will be apparent that certain features of the invention can be combined to form further embodiments. The present embodiments and aspects are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The invention claimed is:

1. A method of gaming in a gaming system comprising:

conducting, via a processor and triggered at least by acceptance of a wager at a credit mechanism in the gaming system and enabled at least in part by one or more hardware meters monitoring credit, a plurality of game rounds, each game round comprising selecting a plurality of symbols for display in respective ones of a plurality of display positions, said plurality of display positions being arranged in a plurality of columns;

determining, via the processor, as part of each game round whether a designated game event has occurred, each designated game event conferring a benefit on the player in at least one game round, wherein the conferred benefit enhances the likelihood of achieving a winning outcome in the at least one game round;

increasing, via the processor, a count at an event counter associated with the gaming system in response to the designated game event occurring in a game round, wherein the count is only increased in response to a first designated event occurring in each of said plurality of columns; and ending, via the processor in communication with the event counter, the series of game rounds in response to the count reaching a designated number provided by the event counter to the processor, wherein the number of game rounds is determined at least in part by a number of the designated game events occurring during play of the plurality of game rounds, and wherein the series of game rounds does not end immediately upon the count reaching the designated number.

2. A method as claimed in claim 1, wherein the benefit conferred by each designated game event persists until the series of game rounds ends.

3. A method as claimed in claim 1, further comprising evaluating each game round to determine whether to make an award to the player.

4. A method as claimed in claim 3, wherein each game round comprises selecting symbols of a plurality of reels for display at a plurality of symbol display positions and evaluating each game round comprises evaluating the symbols displayed at the symbol display positions to determine whether to make an award.

5. A method as claimed in claim 4, wherein the first designated event includes the occurrence of a designated symbol.

6. A method as claimed in claim 5, wherein the designated symbol is a wild symbol.

7. A method as claimed in claim 4, wherein each designated symbol is required to occur in the symbol display positions corresponding to a designated reel.

8. A method as claimed in claim 7, wherein the plurality of first designated events from the plurality of game rounds correspond to designated symbols occurring in symbol display positions of respective ones of a plurality of reels.

9. A method as claimed in claim 8, wherein each designated symbol is held in place, such that for the reel on which it occurs symbols are only selected for other display positions of that reel in any subsequent game rounds.

10. A method as claimed in claim 1, wherein the game is a feature game which is conducted in addition to a main game in response to a trigger condition being met.

11. A method as claimed in claim 1, wherein the first designated event is the occurrence of one or more specified events in a game round such that the count increases by one irrespective of the number of specified events which occur in a game round.

12. A game controller for a gaming system, the game controller comprising a processor to implement at least:

a game round controller arranged to implement, triggered at least by acceptance of a wager at a credit mechanism in the gaming system and enabled at least in part by one or more hardware meters monitoring credit, a plurality of game rounds, each game round comprising selecting a plurality of symbols for display in respective ones of a plurality of display positions, said plurality of display positions being arranged in a plurality of columns; and a designated event monitor arranged to determine as part of each game round whether a designated game event has occurred, each designated game event conferring a benefit on the player in at least one game round, wherein the conferred benefit enhances the likelihood of achieving a winning outcome in the at least one game round, the game round controller arranged to:

increase a count at an event counter associated with the gaming system in response to the designated game event occurring, wherein the count is only increased in response to a first designated event occurring in each of said plurality of columns; and end the series of game rounds in response to the count reaching a designated number, wherein the number of game rounds is determined at least in part by a number of the designated game events occurring during play of the plurality of game rounds, and wherein the series of game rounds does not end immediately upon the count reaching the designated number.

13. A game controller as claimed in claim 12, wherein the game round controller is a feature game controller for conducting the game rounds as feature games in a feature game which is conducted in addition to a main game in response to a trigger condition being met, the main game being conducted by a main game controller.

14. A game controller as claimed in claim 12, comprising a game round evaluator arranged to evaluate each game round to determine whether to make an award to the player.

15. A game controller as claimed in claim 12, wherein the benefit conferred by each designated game event persists until the series of game rounds ends.

16. A game controller as claimed in claim 14, wherein each game round comprises the game controller selecting symbols of a plurality of reels for display at a plurality of symbol display positions and the award evaluator evaluates each game round by evaluating the symbols displayed at the symbol display positions to determine whether to make an award.

17. A game controller as claimed in claim 16, wherein the first designated event includes the occurrence of a designated symbol.

18. A game controller as claimed in claim 17, wherein the designated symbol is a wild symbol.

19. A game controller as claimed in claim 16, wherein each designated symbol is required to occur in the symbol display positions corresponding to a designated reel.

20. A game controller as claimed in claim 19, wherein the plurality of first designated events from the plurality of game rounds correspond to designated symbols occurring in symbol display positions of respective ones of a plurality of reels.

21. A game controller as claimed in claim 20, wherein each designated symbol is held in place, such that for the reel on which it occurs symbols are only selected for other display positions of that reel in any subsequent game rounds.

22. A game controller as claimed in claim 12, wherein the first designated event is the occurrence of one or more specified events in a game round such that the count increases by one irrespective of the number of specified events which occur in a game round.

23. A gaming system comprising:

a display for displaying play of the game to a player; and a game controller including a processor arranged to:

conduct, triggered at least by acceptance of a wager at a credit mechanism in the gaming system and enabled at least in part by one or more hardware meters monitoring credit, a plurality of game rounds, each game round comprising selecting a plurality of symbols for display in respective ones of a plurality of display positions, said plurality of display positions being arranged in a plurality of columns;

determine as part of each game round whether a designated game event has occurred, each designated game event conferring a benefit on the player in at least one game round, wherein the conferred benefit enhances the likelihood of achieving a winning outcome in the at least one game round;

increase a count at an event counter associated with the gaming system in response to the designated game event occurring in a game round, wherein the count is only increased in response to a first designated event occurring in each of said plurality of columns; and end the series of game rounds in response to the count reaching a designated number, wherein the number of game rounds is determined at least in part by a number of the designated game events occurring during play of the plurality of game rounds, and wherein the series of game rounds does not end immediately upon the count reaching the designated number.

24. A gaming system as claimed in claim 23, wherein the benefit conferred by each designated game event persists until the series of game rounds ends.

25. A gaming system as claimed in claim 23, wherein the game controller is further arranged to evaluate each game round to determine whether to make an award to the player.

26. A gaming system as claimed in claim 25, wherein each game round comprises the game controller selecting symbols of a plurality of reels for display at a plurality of symbol display positions and the game controller evaluates each game round by evaluating the symbols displayed at the symbol display positions to determine whether to make an award.

27. A gaming system as claimed in claim 26, wherein the first designated event includes the occurrence of a designated symbol.

28. A gaming system as claimed in claim 27, wherein the designated symbol is a wild symbol.

29. A gaming system as claimed in claim 26, wherein each designated symbol is required to occur in the symbol display positions corresponding to a designated reel.

30. A gaming system as claimed in claim 29, wherein the plurality of first designated events from the plurality of game rounds correspond to designated symbols occurring in symbol display positions of respective ones of a plurality of reels.

31. A gaming system as claimed in claim 30, wherein each designated symbol is held in place by the game controller, such that for the reel on which it occurs symbols are only selected by the game controller for other display positions of that reel in any subsequent game rounds.

32. A gaming system as claimed in claim 23, wherein the game is a feature game which is conducted in addition to a main game in response to the game controller determining that a trigger condition has been met.

33. A gaming system as claimed in claim 23, wherein the first designated event is the occurrence of one or more specified events in a game round such that the game controller increases the count by one irrespective of the number of specified events which occur in a game round.

34. A gaming machine comprising:

a cabinet;

a display mounted within the cabinet for displaying play of the game to a player;

one or more input devices including a credit meter and one or more hardware meters operable by a player to place a wager and initiate play of the game; and a game controller in data communication with the input devices and display, the game controller comprising a processor arranged to execute program code stored in a memory in order to conduct a game in response to operation of the one or more input devices, the program code including instructions such that at least occasionally, the game controller, will as part of game play:

conduct, triggered at least by acceptance of a wager at a credit mechanism in the gaming system and enabled at least in part by one or more hardware meters monitoring credit, a plurality of game rounds, each game round comprising selecting a plurality of symbols for display in respective ones of a plurality of display positions, said plurality of display positions being arranged in a plurality of columns;

determine as part of each game round whether a designated game event has occurred, each designated game event conferring a benefit on the player in at least one game round, wherein the conferred benefit enhances the likelihood of achieving a winning outcome in the at least one game round;

increase a count at an event counter associated with the gaming system in response to the designated game event occurring in a game round, wherein the count is only increased in response to a first designated event occurring in each of said plurality of columns; and end the series of game rounds in response to the count reaching a designated number, wherein the number of game rounds is determined at least in part by a number of the designated game events occurring during play of the plurality of game rounds, and wherein the series of game rounds does not end immediately upon the count reaching the designated number.

35. A gaming system comprising:

means for displaying play of a game to a player;

means for conducting, triggered at least by acceptance of a wager at a credit mechanism in the gaming system and enabled at least in part by one or more hardware meters monitoring credit, a plurality of game rounds, each game round comprising selecting a plurality of symbols for display in respective ones of a plurality of display positions, said plurality of display positions being arranged in a plurality of columns;

means for determining as part of each game round whether a designated game event has occurred, each designated game event conferring a benefit on the player in at least one game round, wherein the conferred benefit enhances the likelihood of achieving a winning outcome in the at least one game round;

means for increasing a count at an event counter associated with the gaming system in response to the designated game event occurring in a game round, wherein the count is only increased in response to a first designated event occurring in each of said plurality of columns; and means for ending the series of game rounds in response to the count reaching a designated number, wherein the number of game rounds is determined at least in part by a number of the designated game events occurring during play of the plurality of game rounds, and wherein the series of game rounds does not end immediately upon the count reaching the designated number.

36. A non-transitory computer readable storage medium including computer program code which when executed by a processor implements a method of gaming in a gaming system comprising:

conducting, via the processor and triggered at least by acceptance of a wager at a credit mechanism in the gaming system and enabled at least in part by one or more hardware meters monitoring credit, a plurality of game rounds, each game round comprising selecting a plurality of symbols for display in respective ones of a plurality of display positions, said plurality of display positions being arranged in a plurality of columns;

determining, via the processor, as part of each game round whether a designated game event has occurred, each designated game event conferring a benefit on the player in at least one game round, wherein the conferred benefit enhances the likelihood of achieving a winning outcome in the at least one game round;

increasing, via the processor, a count at an event counter associated with the gaming system in response to the designated game event occurring in a game round, wherein the count is only increased in response to a first designated event occurring in each of said plurality of columns; and ending, via the processor in communication with the event counter, the series of game rounds in response to the count reaching a designated number provided by the event counter to the processor, wherein the number of game rounds is determined at least in part by a number of the designated game events occurring during play of the plurality of game rounds, and wherein the series of game rounds does not end immediately upon the count reaching the designated number.

* * * * *